US009923292B2

(12) United States Patent
Peloza et al.

(10) Patent No.: US 9,923,292 B2
(45) Date of Patent: Mar. 20, 2018

(54) CONNECTOR HAVING A HOUSING WITH CLOSED LOOP TERMINALS

(71) Applicants: Kirk B. Peloza, Lisle, IL (US); Michael Rowlands, Lisle, IL (US); Kent E. Regnier, Lisle, IL (US); MOLEX INCORPORATED, Lisle, IL (US)

(72) Inventors: Kirk B. Peloza, Naperville, IL (US); Michael Rowlands, Naperville, IL (US); Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/910,352

(22) PCT Filed: Aug. 7, 2014

(86) PCT No.: PCT/US2014/050040
§ 371 (c)(1),
(2) Date: Feb. 5, 2016

(87) PCT Pub. No.: WO2015/021221
PCT Pub. Date: Feb. 12, 2015

(65) Prior Publication Data
US 2016/0181713 A1 Jun. 23, 2016

Related U.S. Application Data

(60) Provisional application No. 61/863,044, filed on Aug. 7, 2013.

(51) Int. Cl.
*H01R 12/00* (2006.01)
*H01R 12/73* (2011.01)
*H01R 12/72* (2011.01)

(52) U.S. Cl.
CPC ..... *H01R 12/737* (2013.01); *H01R 12/724* (2013.01); *H01R 12/73* (2013.01)

(58) Field of Classification Search
CPC ..... H01R 12/72; H01R 12/21; H01R 12/722; H01R 12/724; H01R 12/725; H01R 12/727; H01R 12/73; H01R 12/732; H01R 12/735; H01R 12/737
USPC ..... 439/60, 62, 629, 630, 541.5
See application file for complete search history.

(56) References Cited

U.S. PATENT DOCUMENTS 3,289,148 A * 11/1966 Antes ..... H01R 12/721 439/637
3,601,782 A * 8/1971 Gillissen ..... H01R 12/721 439/636
4,094,573 A * 6/1978 Langham ..... H01R 12/721 439/634

(Continued)

FOREIGN PATENT DOCUMENTS

TW 191302 9/1992

*Primary Examiner* — Chandrika Prasad
(74) *Attorney, Agent, or Firm* — Jeffrey K. Jacobs

(57) ABSTRACT

A connector includes terminals. The terminals can have a contact that has a loop configuration. In an embodiment the contacts are positioned in a vertical connector similar to an edge card connector but with a differential pair aligned in a vertical direction. Thus the connector can provide edge-coupled differential pair in a high density configuration.

10 Claims, 10 Drawing Sheets

(56) References Cited

U.S. PATENT DOCUMENTS

| | | | | | |
|---|---|---|---|---|---|
| 4,226,496 | A | * | 10/1980 | Langham | H01R 12/721 439/637 |
| 5,024,609 | A | | 6/1991 | Piorunneck | |
| 5,051,099 | A | * | 9/1991 | Pickles | H01R 12/721 439/108 |
| 5,424,734 | A | * | 6/1995 | Hirahara | H03K 19/1736 341/79 |
| 5,496,180 | A | * | 3/1996 | Fabian | H01R 4/028 439/60 |
| 5,997,312 | A | | 12/1999 | Ho et al. | |
| 6,015,299 | A | * | 1/2000 | Walse | H01R 12/721 439/60 |
| 7,422,483 | B2 | | 9/2008 | Avery et al. | |
| 8,033,841 | B2 | | 10/2011 | He | |
| 9,368,895 | B2 | | 6/2016 | Ueno et al. | |
| 2003/0045138 | A1 | | 3/2003 | Su et al. | |
| 2006/0063429 | A1 | | 3/2006 | Tsai | |
| 2010/0022138 | A1 | | 1/2010 | Miyoshi et al. | |

* cited by examiner

CONNECTOR HAVING A HOUSING WITH CLOSED LOOP TERMINALS

RELATED APPLICATIONS

This application is a national phase of PCT Application No. PCT/US2014/050040, filed Aug. 7, 2014, which claims priority to U.S. Provisional Application No. 61/863,044, filed Aug. 7, 2013, which is incorporated herein by reference in its entirety.

TECHNICAL FIELD

This disclosure relates to field of connectors, more specifically to the field of connectors intended for supporting high data rates.

DESCRIPTION OF RELATED ART

Daughter cards and memory modules are commonly mounted to a main circuit board via a vertical connector. The vertical connector will typically will include a mating slot and will include terminals mounted on both sides of the mating slot, the terminals having contacts that arranged in a desired pattern, depending on whether the terminals are configured for differential or single-ended signaling. For differential signaling the signal contacts will typically be arranged in signal, signal, ground configuration that repeats as desired. Single-ended configurations may have a signal, ground pattern that repeats as desired. While single ended configurations have more channels, the single-ended system is more susceptible to cross talk than the differential configuration and thus often will require additional shielding or will be forced to function at lower data rates in order to provide reliable signaling. While it is possible to reduce the pitch of terminals somewhat, eventually tolerance issues prevent further improvements in density. Certain individuals would appreciate a connector system that could provide greater density of signaling.

SUMMARY

A connector is disclosed that includes a housing with a slot. The slot can extend longitudinally along the housing. Terminals are supported by the housing and configured to provide contacts on both sides of the slot. The contacts of the terminals have a loop configuration. The contact can be configured such that the loop has a length that is great than a width. In an embodiment the connector can include vertically aligned differential pair in the slot and can provide two rows of terminals on each side of the slot.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
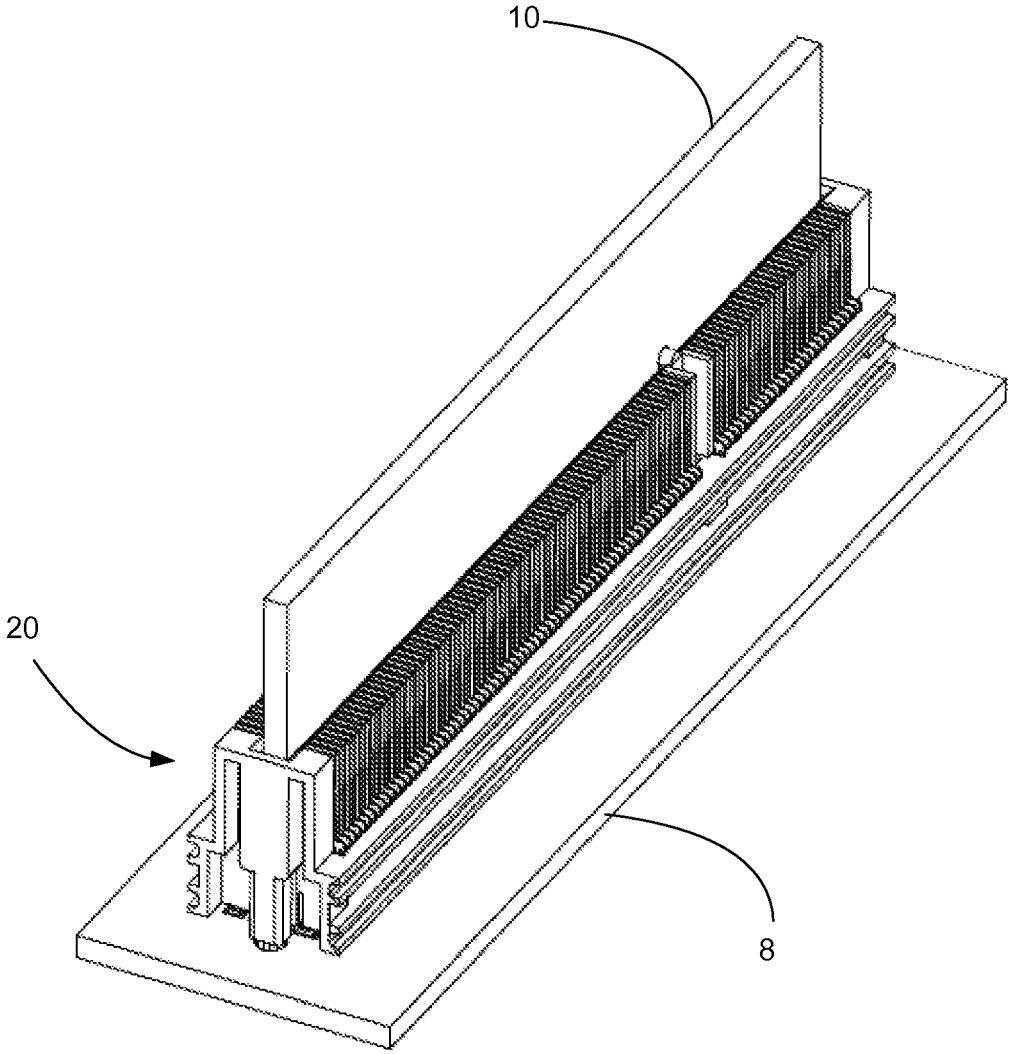
FIG. 1 illustrates a perspective view of an embodiment of a connector mated to a board.
Figure 2:
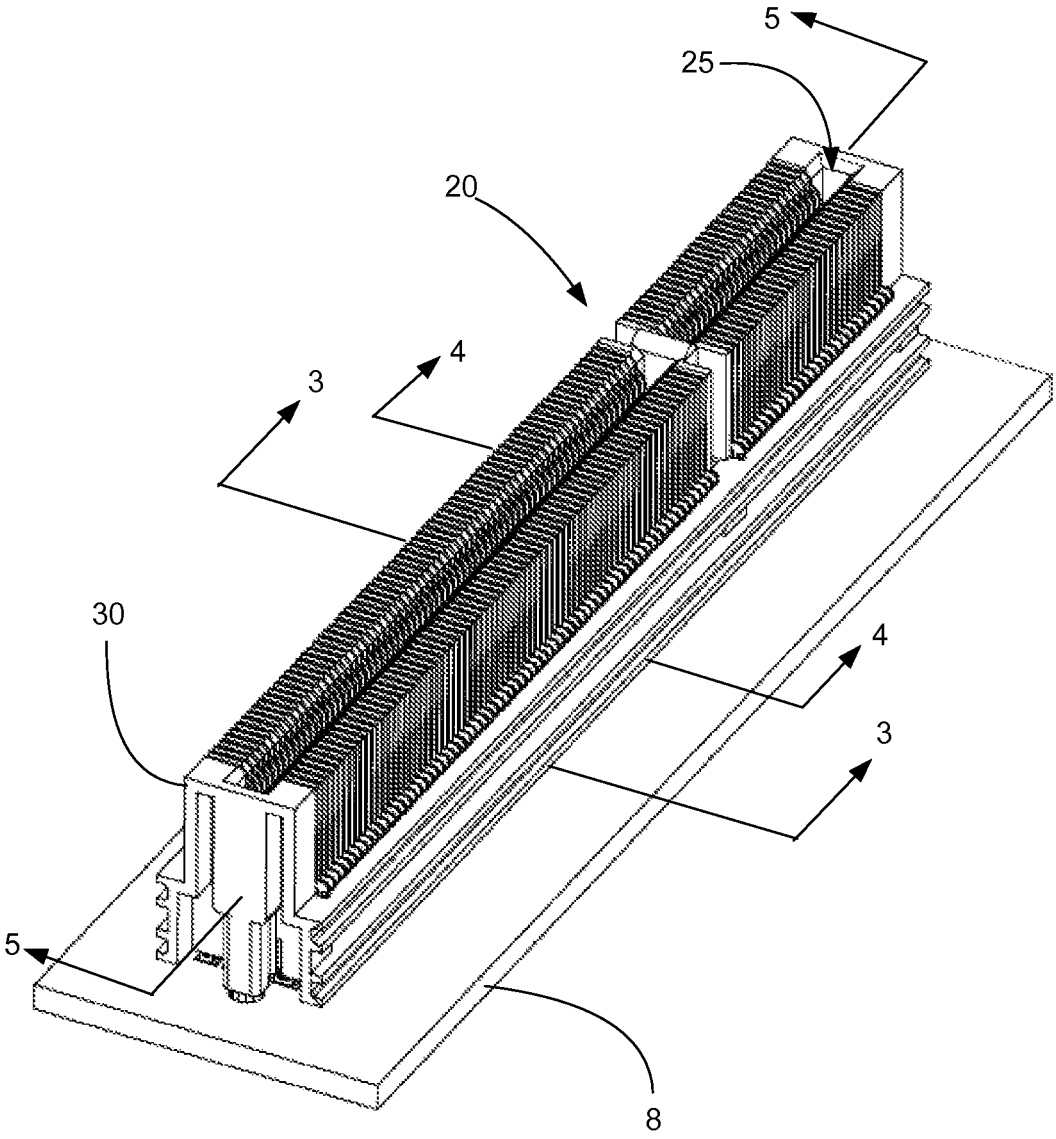
FIG. 2 illustrates a perspective view of an embodiment of a connector.
Figure 3:
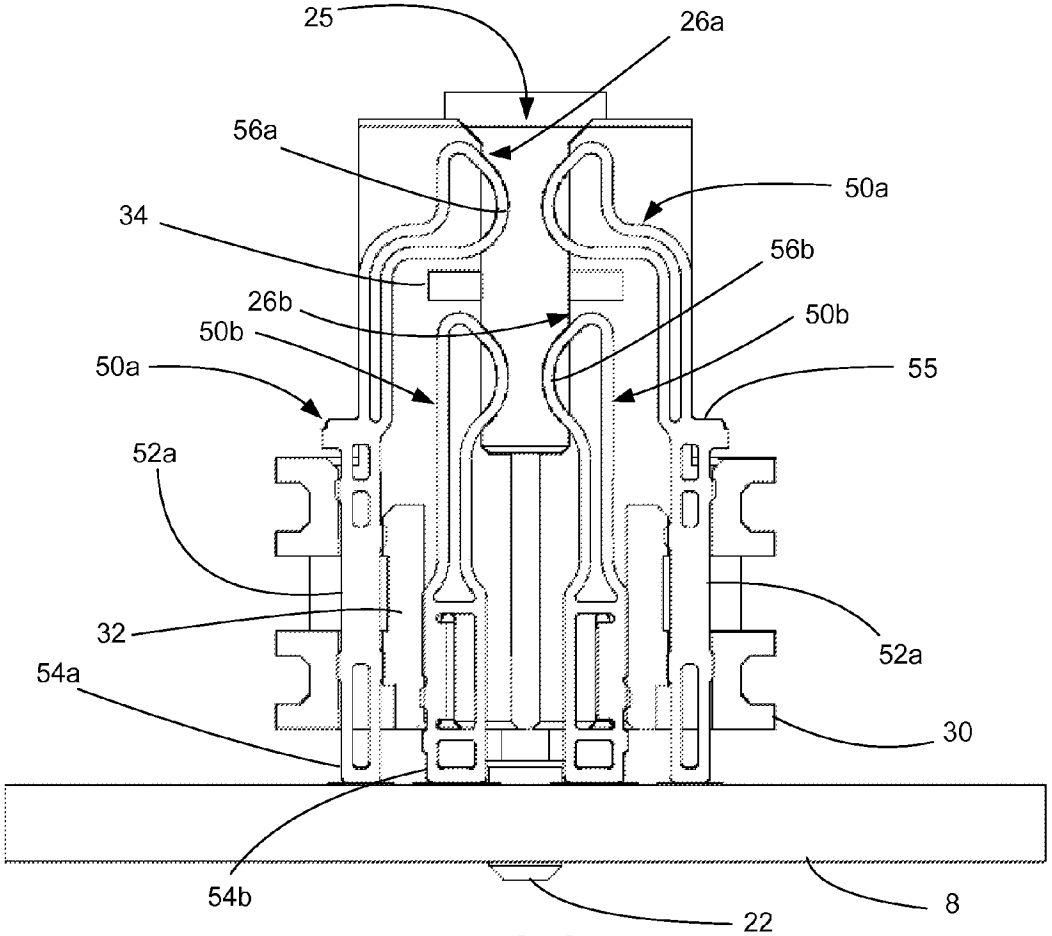
FIG. 3 illustrates an elevated view of a cross section of the embodiment depicted in FIG. 2, taken along line 3-3.
Figure 4:
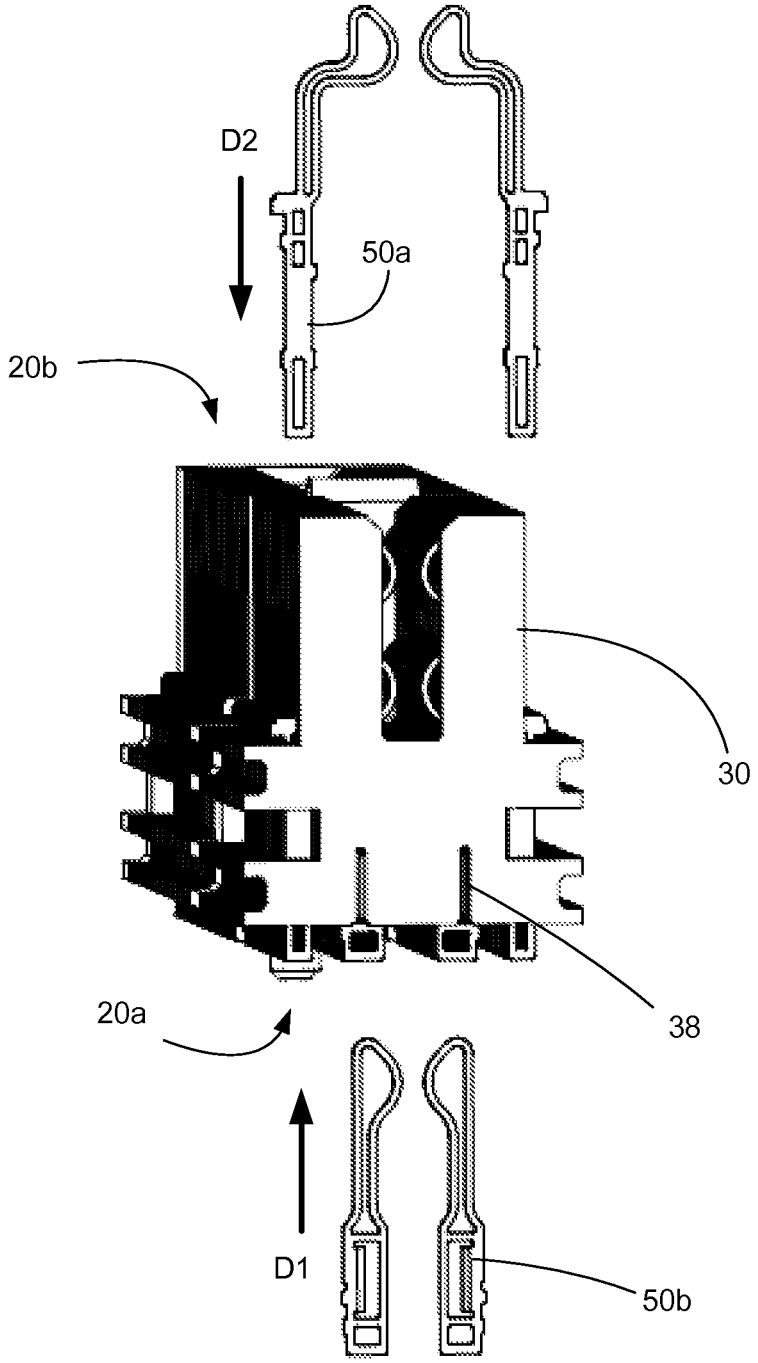
FIG. 4 illustrates a perspective partially exploded view of a cross section of the embodiment depicted in FIG. 2, taken along line 4-4.
Figure 5:
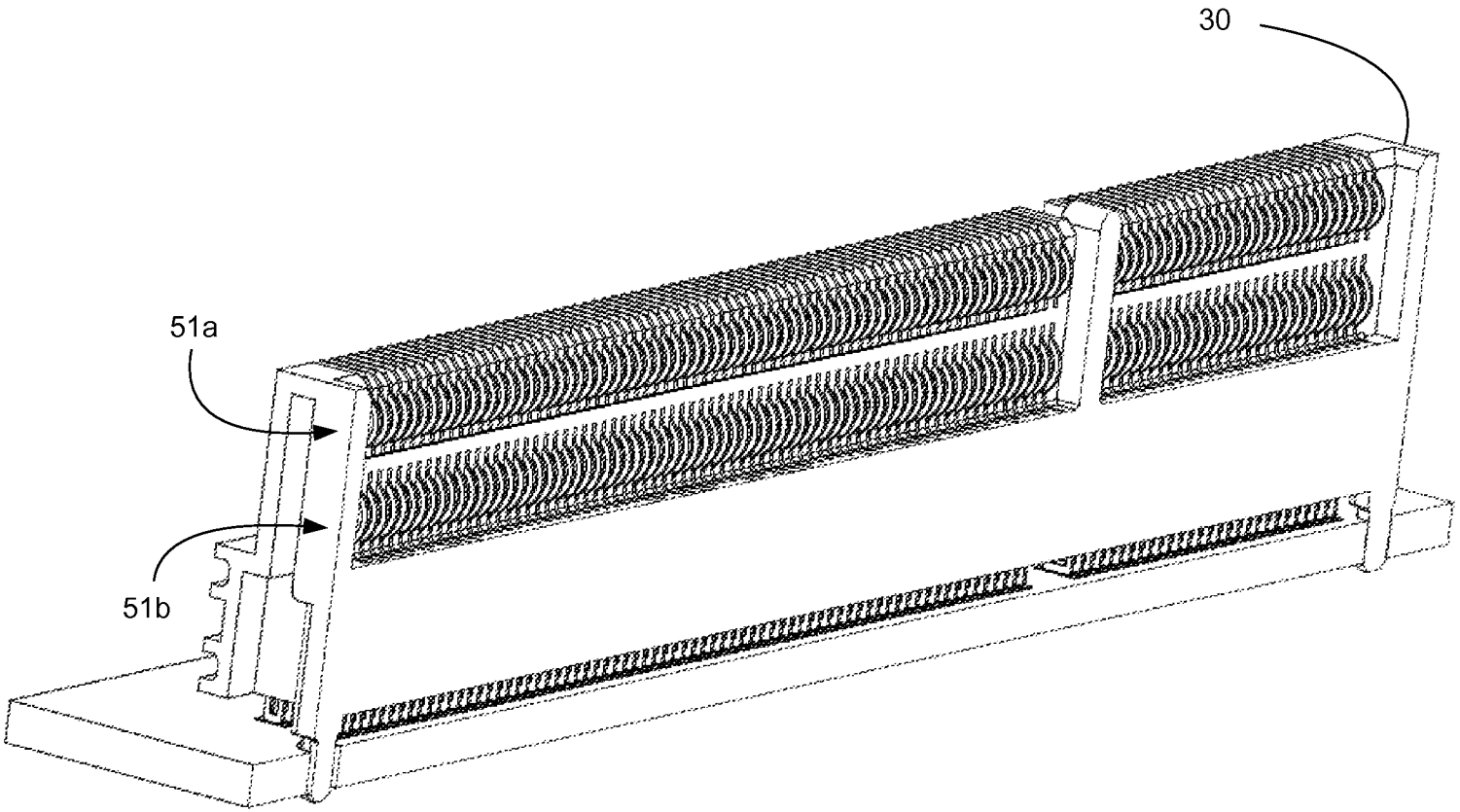
FIG. 5 illustrates a perspective view of a cross section of the embodiment depicted in FIG. 2, taken along line 5-5.
Figure 6:
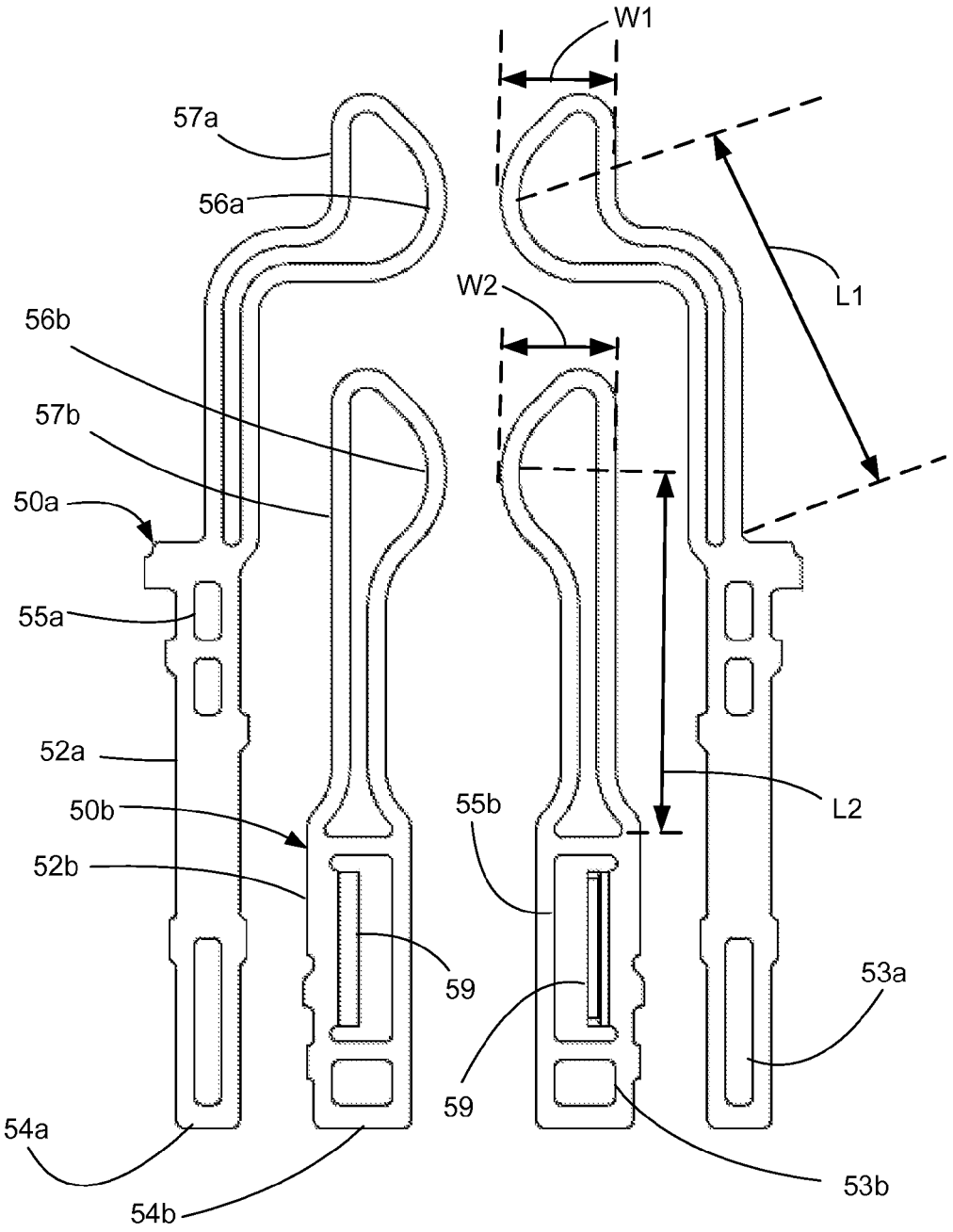
FIG. 6 illustrates an elevated side view of an embodiment of terminals.
Figure 7:
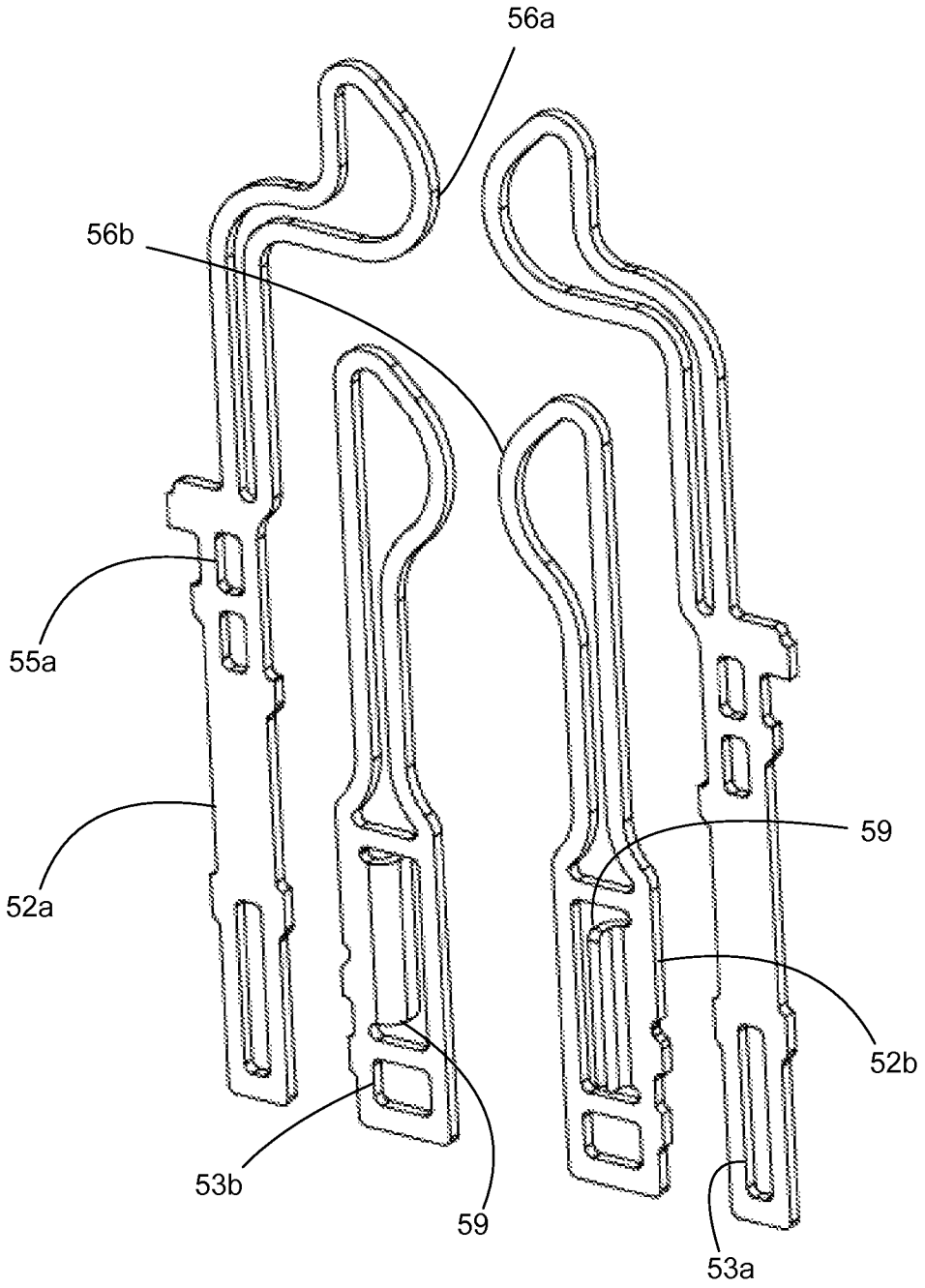
FIG. 7 illustrates a perspective view of the embodiment depicted in FIG. 6.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

It should be noted that the depicted configuration is not intended to be limiting. For example, while the depicted embodiment shows terminals on two sides of a longitudinal slot, terminals could be positioned on just one side. In addition, while terminals are shown aligned in vertical pairs so that a differential pair can be provided on a single vertical plane, small amounts of offset could be used. Furthermore, the terminals need not be used in pairs but instead could be used in a single row (e.g., just a top row or a bottom row). Thus, a number of variations can be provided to the depicted connector configuration and therefore the depicted configuration is not intended to be limiting.

Turning to the FIGS, a connector 20 with a mounting face 20*a* and a mating face 20*b* is configured to be mounted on a circuit board 8 on the mounting face 20*a*. The connector 20 has a slot 25 that extends longitudinally along a housing 30 on the mating face 20*b* and terminals are depicted on both sides of the slot 25. The connector 20 is configured to receive an edge card 10 and can be considered a vertical connector.

The depicted embodiment includes terminal 50*a* and 50*b* that together form a differential pair provided in a plane that is orthogonal to the supporting circuit board 8. One or more legs 22 can be used to secure the connector 20 to the circuit board 8. As depicted, terminals on a first side of the longitudinal slot 25 form two rows 51*a*, 51*b*. These same terminals can be flipped over and used on a second side of the slot 25 to form two similar rows. Thus, as depicted, terminals 50*a* and 50*b* can be used on both sides of the slot 25 so as to provide two opposing rows of terminals. Each of the terminals 50*a*, 50*b* include a body 52*a*, 52*b*, a tail 54*a*, 54*b* and a contact 56*a*, 56*b*. As can be appreciated, each of the depicted terminals have the tail, body and contact arranged so that they each are in the same plane and thus each of the terminal can be considered planar-shaped terminal. The contacts 56*a*, 56*b* are formed as a loop and include back frame 57*a*, 57*b* that helps support the contacts 56*a*, 56*b*. As can be appreciated, the loop formed by the contact 56*a* and the back frame 57*a* is elongated (rather than circular) in shape and it is expected that most suitable loops will be elongated somewhat so as to provide the desired contact force. Preferably the terminal will be elongated such that L1 is more than 2 times W1 (L1 being the length from the start of the loop to the center of the contact point and W1 being the width at the contact point) and more preferably L1 will be more than three times W1 so as to provide the desired spring rate (as discussed below). Similarly, L2 can be more than 2 times W2 and more preferably L2 will be more than 3 times W2.

The terminals include anti-solder notches 53*a*, 53*b* that help resist wicking of solder up the body 52*a*, 52*b* while also providing desirable impedance tuning. The body 52*a*, 52*b* can also include tuning notches 55*a*, 55*b* to adjust the impedance of the terminals. To help secure terminal 50*b* in place, a shoulder 59 extends is formed out of the plane formed by the terminal body, tail and contact. The shoulder 59 is configured to engage housing groove 38 and the terminal 50*b* is secured in the housing 30 by engaging housing groove 38 and retention lip 32 (which may have projections or recesses to help engage the terminal 50*b*).

As can be appreciated, terminals 50*b* are inserted into the housing 30 in a first direction D1 while terminals 50*a* are inserted into the housing 30 in a second direction D2. In the depicted embodiment the first direction D1 is opposite the second direction D2. Such a construction is useful in a connector configured to vertically engage a mating system, particularly in a system that provides two rows of terminals on one side of a slot with the two rows of terminals being vertically spaced apart. Alternatively the slot could be provided in a right angle connector and in such a system the body or the loop would need to provide a 90 bend (naturally the housing would need the appropriate apertures to allow the terminals to be inserted if the connector continued to use stitched terminals).

The depicted connector 20 has configured the housing 30 so that much of the terminals are exposed to air over a substantial portion of their length. This provides a lower effective dielectric constant and can help improve the efficiency of the connector system.

As noted above, while the terminals 50*a*, 50*b* are configured so as to provide a differential pair in a vertical plane (assuming the supporting circuit board defines a horizontal plane), this configuration is intended for use in designs where high density is desired. In such a configuration a different pair can be separated by a ground pair and thus a repeating signal, ground configuration is provided. However, unlike conventional single-ended systems, the depicted connector provides a differential pair between each ground. Thus, the density of the particular system is substantially greater than convention systems. For example, assuming 0.8 mm pitch, compared to a connector with a ground, signal, signal pattern the illustrated embodiment can provide three channels in 4.8 mm while a conventional system could only provide 2 channels. Thus, the depicted embodiment can be considered a 50% improvement in density over connectors with conventional ground, signal, signal patterns while still providing good electrical performance due to the fact that the signal terminals that form the differential pair can be shielded on both sides. Thus, the depicted connector design provides for an edge-coupled differential pair while still supporting a slot that is designed to interface with a card edge.

In the depicted embodiment the tails of the terminals are configured to be mounted to the supporting circuit board 8 via surface mount attach (SMT). This is useful in situations where the density of the tails is such that there is not space for vias to be positioned adjacent each other. For example, if the vias are 0.49 mm diameter then placing the terminals on a 0.8 mm pitch would only leave about 0.2 mm of board between adjacent vias (which would be undesirable from a manufacturing and performance standpoint). However, SMT is amendable to such an arrangement as the pads on the supporting circuit board can be made small and signal vias can be much smaller than the vias needed to support press-fit or through-hole tails. Alternatively, the tails could be configured in a press-fit or through-hole configuration (e.g., conventional variations in the type of tail) with either more space or the use of offset tails. Thus, the depicted configuration, while beneficial, is not intended to be limiting.

As noted above, the above configuration depicts tails that are intended to be inserted into an already formed housing (e.g., the terminals are intended to be stitched into the housing). Such a construction is cost effective and beneficial, especially when a larger number of terminals are going to be positioned close to each other (e.g., when the connector is intended to provide a dense configuration). Alternatively, the terminals could be secured in a wafer with an insert-molding operation (as is known). The wafers would then be inserted into the housing and a plastic web of the wafer would help support the terminals in the desired position. Such a construction is common for right-angled connectors.

Terminals with a loop configuration, regardless of whether they are stitched or insert-molded, can provide beneficial impedance control as well as the benefit of providing a low-rate spring. This provides for less permanent set when the terminal engages the mating contact and allows for an increased operating range. The improved beam flexibility makes the contacts tougher (which is contrary to expectations as the thin wire-frame nature of the loop would appear to be more fragile on its face). In addition, the loop configuration also provides less rotation of the contact during mating, which helps keep mating force lower. Furthermore, fretting is reduced. Finally, the position of the contact (due to the increased distance between the contact and the back frame compared to the width of conventional terminals) is easier to control.

Figure 8:
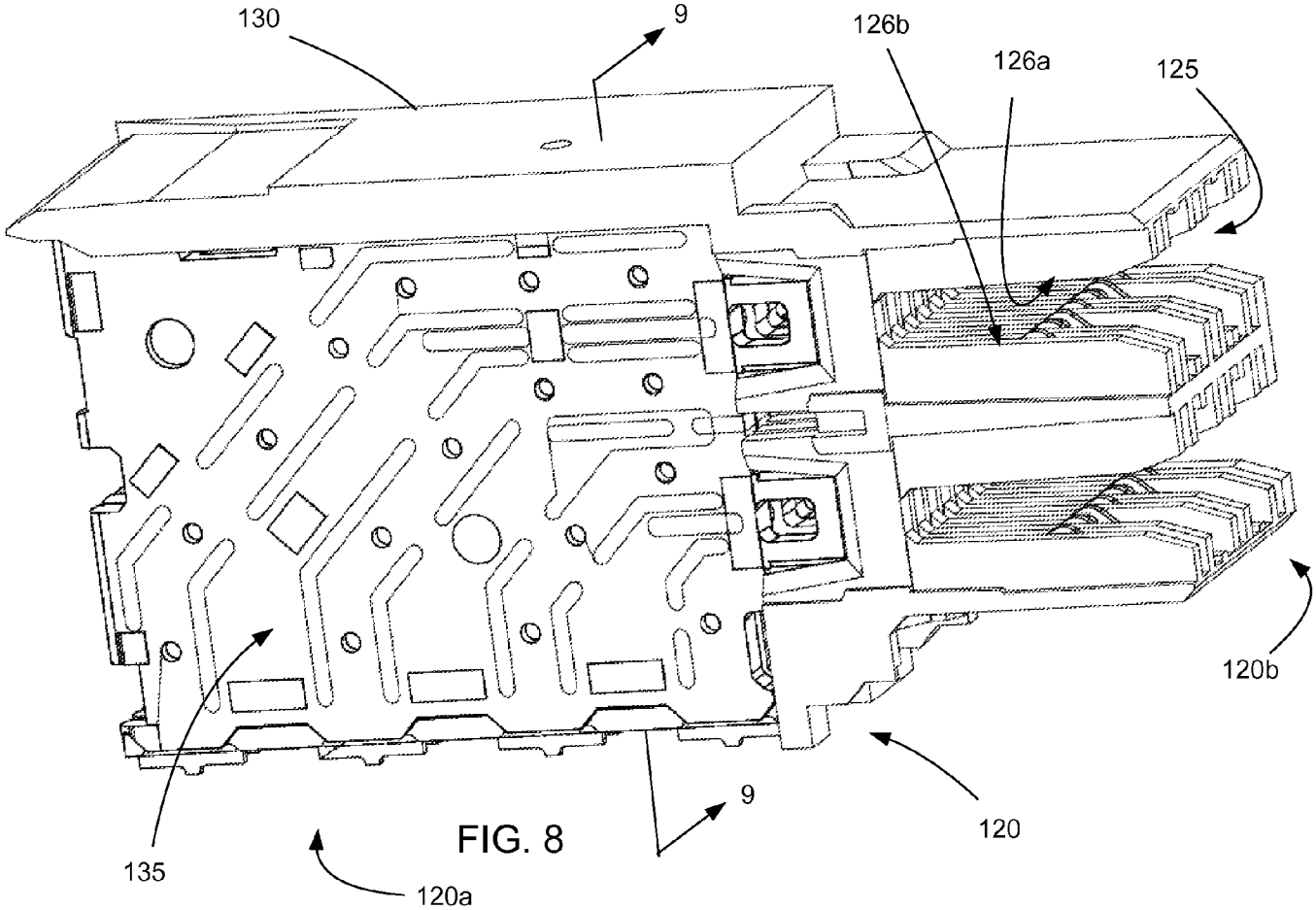
FIG. 8 illustrates a perspective partial view of an embodiment of a right angle connector.
Figure 9:
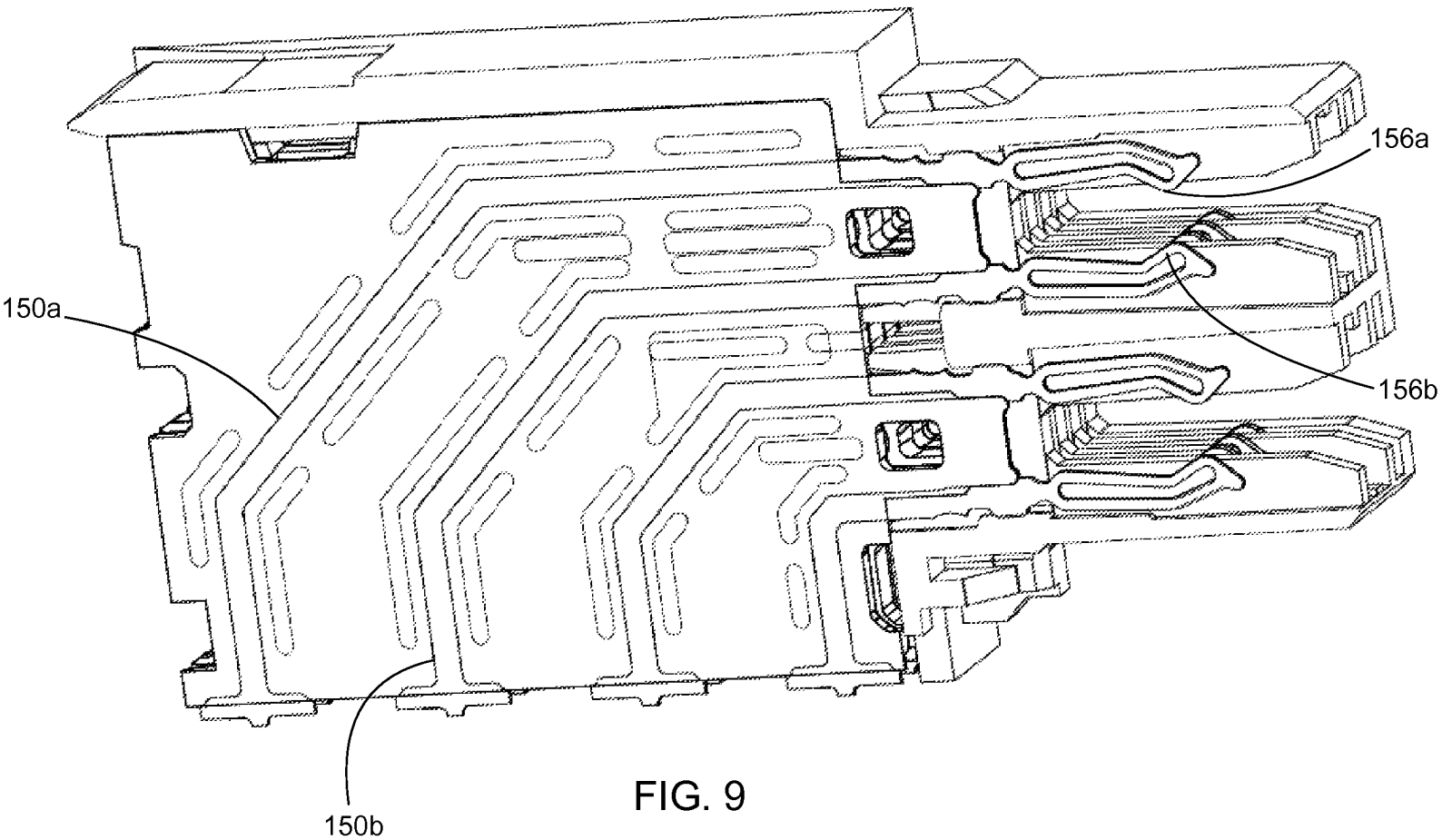
FIG. 9 illustrates a perspective view of a cross section of the embodiment depicted in FIG. 8, taken along line 9-9.
Figure 10:
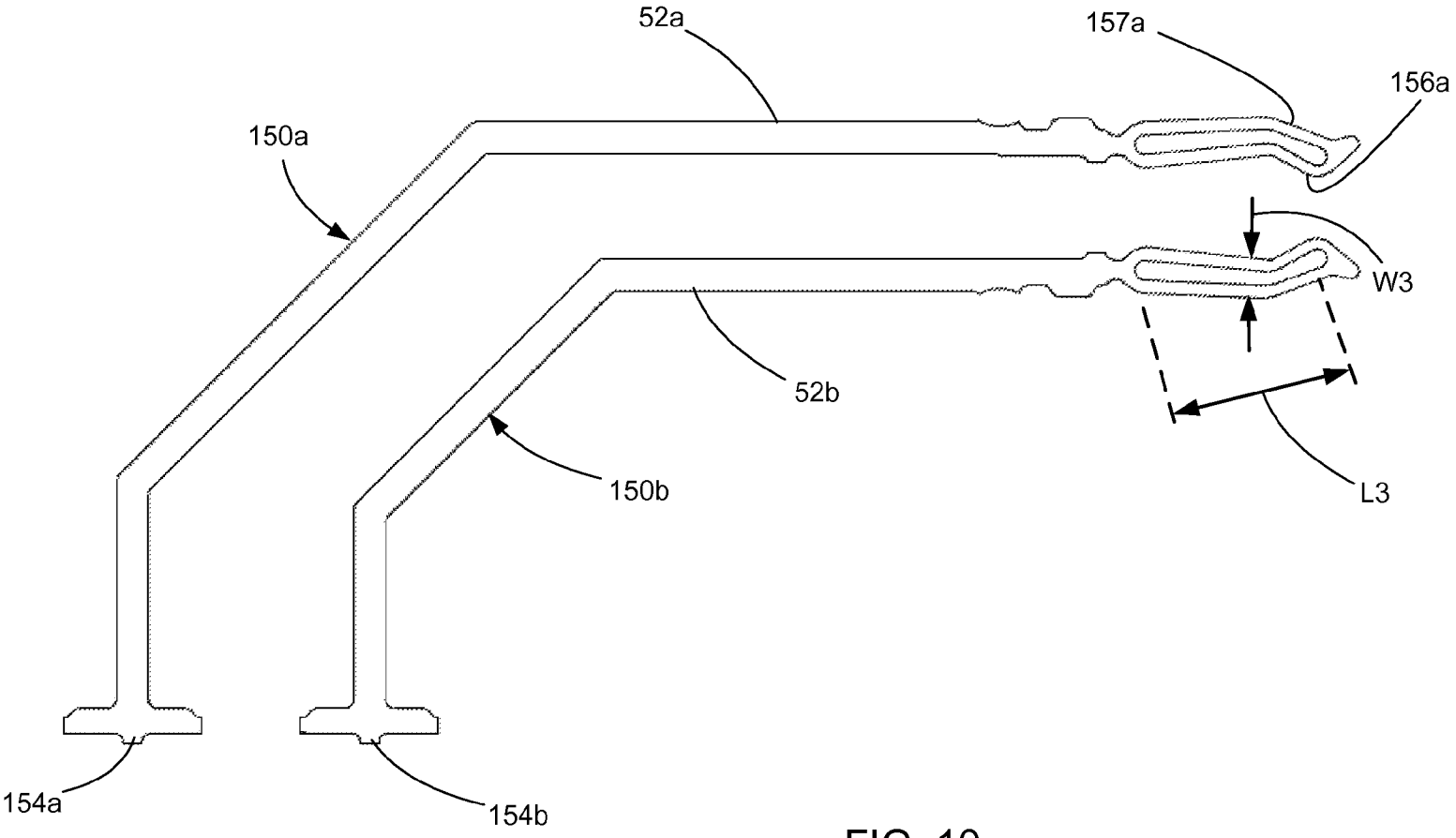
FIG. 10 illustrates an elevated side view of two terminals suitable for use with the embodiment depicted in FIG. 8.

Another embodiment is depicted in FIGS. 8-10. A connector 120 with a mounting side 120*a* and a mating side 120*b* is depicted with a housing 130 (that is partially cut away to better show certain details) that supports a plurality of wafers 135 and the housing includes one or more slots 125 (while two slots are depicted, providing only one slot is would be straightforward to provide and is considered within the scope of the disclosure). Each slot 125 has a first side 126*a* and a second side 126*b*.

The wafer 135 supports terminals, such as terminals 150*a*, 150*b* and helps ensure contacts 156*a*, 156*b* are positioned in the slot 125. The terminals 150*a*, 150*b* include a body 152*a*, 152*b*, a tail 154*a*, 154*b* and a contact 156*a*, 156*b* (similar to the terminals 50*a*, 50*b*). One difference is that terminals 150*a*, 150*b* are configured for a right-angle connector rather than a vertical connector and thus provide for a 90 degree bend between the tails and the contacts (as is conventional for terminals in right angle connectors).

As can be appreciated, the contact 156*a*, 156*b* has a loop configuration and is supported by back frame 157*a*, 157*b* respectively. The contact is configured such that the resultant loop has a length L3 is greater than a width W3 (similar to the terminals discussed above). For purposes of clarification, the width is expected to be measured as the widest point along the length. Preferably the length L3 will be at least 2 times the width W3. As can be appreciated, the configuration of the connector 120 provides for a less dense mating interface as the terminals can be arranged in a repeating ground, signal, signal pattern. However, the loop configuration allows for a lower impedance value (thus supporting an 85 ohm configuration) while using materials with only moderate dielectric constants (for example, having a dielectric constant of 3.5). Conventional terminals would require the use of housing materials with a dielectric constant greater than 4 and such materials are more difficult to work with from a molding perspective. Thus it has been determined that the depicted configuration is well suited to providing lower impedance connector systems in an application where the connector housing is formed of a material having a dielectric constant of less than 4 while providing an 85 ohm connector system.

Accordingly, an embodiment of a connector includes a housing with a slot having a first side and a second side. A first row of terminals is supported by the housing, each of the terminals in the first row having a first contact positioned on the first side of the slot, each of the first contacts having a loop configuration where the loop has a length and a width, the length being at least twice the width. The connector further includes a second row of terminals supported by the housing. Each of the terminals in the second row have a second contact positioned on the second side of the slot and each of the second contacts having a loop configuration where the loop has a length and a width, the length being at least twice the width.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing having a slot with opposite sides that extend longitudinally along the housing and a central plane parallel with the opposite sides and midway therebetween, the housing configured to mount vertically on a circuit board;

a first terminal having a first contact with a first contact edge, the first terminal being substantially planar shaped and the first contact edge being an edge of the first contact most extended in a direction orthogonal to the central plane of the slot; and a second terminal having a second contact with a second contact edge, the second terminal being substantially planar shaped and the second contact edge being an edge of the second contact most extended in a direction orthogonal to the central plane of the slot, the first and second contact edges being vertically aligned on a first side of the slot, wherein the first and second terminals are configured to provide a differential pair with both terminals in a plane that is orthogonal to the circuit board, wherein each of the contacts of the first and second terminals are configured in a loop which is closed.

2. The connector of claim 1, wherein each of the loops has a length and a width and the length is at least two times the width.

3. The connector of claim 2, further comprising a third terminal having a third contact with a third contact edge and a fourth terminal having a fourth contact with a fourth contact edge, the third contact edge being an edge of the third contact most extended in a direction orthogonal to the central plane of the slot, the fourth contact edge being an edge of the fourth contact most extended in a direction orthogonal to the central plane of the slot, the third and fourth contact edges being vertically aligned on a second side of the slot.

4. The connector of claim 3, wherein the first, second, third and fourth contacts are in the plane orthogonal to the circuit board.

5. A connector, comprising:

a housing with a slot having a first side and a second side;

a first row of terminals supported by the housing, each of the terminals in the first row having a first contact positioned on the first side of the slot, each of the first contacts having a loop configuration wherein the loop has a length and a width, the length being at least twice the width; and a second row of terminals supported by the housing, each of the terminals in the second row having a second contact positioned on the second side of the slot, each of the second contacts having a loop configuration wherein the loop has a length and a width, the length being at least twice the width, wherein the loop configuration of each of the first contacts is a closed-loop configuration and the loop configuration of each of the second contacts is a closed-loop configuration.

6. The connector of claim 5, wherein the connector is a right angle connector.

7. The connector of claim 5, wherein the connector is a vertical connector.

8. A connector, comprising:

a housing having a slot with opposite sides that extend longitudinally along the housing, the housing configured to mount on a circuit board;

a first terminal having a first contact with a first contact portion, the first terminal being substantially planar shaped and the first contact portion being a portion of the first contact extending into the slot between the opposite sides; and a second terminal having a second contact with a second contact portion, the second terminal being substantially planar shaped and the second contact portion being a portion of the second contact extending into the slot between the opposite sides, the first and second contact portions being aligned on a first side of the slot such that the second contact portion is between the first contact portion and the circuit board, wherein the first and second terminals are configured to provide a differential pair with both terminals in a plane that is orthogonal to the circuit board, wherein each of the contacts of the first and second terminals are configured in a loop which is closed.

9. The connector of claim 8, wherein each of the loops has a length and a width and the length is at least two times the width.

10. The connector of claim 8, further comprising a third terminal having a third contact and a fourth terminal having a fourth contact, the third and fourth contacts being on a second side of the slot, wherein the first, second, third and fourth contacts are in the plane orthogonal to the circuit board.

* * * * *